United States Patent [19]

Wierenga et al.

[11] Patent Number: 4,954,285

[45] Date of Patent: Sep. 4, 1990

[54] PERFUME, PARTICLES, ESPECIALLY FOR USE IN DRYER RELEASED FABRIC SOFTENING/ANTISTATIC AGENTS

[75] Inventors: Thomas J. Wierenga, Cincinnati; Joseph M. Ladd, Jr., Cleves; Russell J. Merz, Hamilton; Alyce E. Nicholson, Morrow, all of Ohio

[73] Assignee: The Procter & Gamble Company, Cincinnati, Ohio

[21] Appl. No.: 306,334

[22] Filed: Feb. 7, 1989

Related U.S. Application Data

[63] Continuation-in-part of Ser. No. 164,678, Mar. 7, 1988, abandoned.

[51] Int. Cl.[5] ..... C11D 13/46

[52] U.S. Cl. ..... 252/174.11; 252/8.6; 252/8.8; 8/522

[58] Field of Search ..... 252/174.11, 8.8, 8.6; 8/522

[56] References Cited

U.S. PATENT DOCUMENTS

| | | | |
|---|---|---|---|
| 3,681,248 | 8/1972 | Gould et al. | 252/174.11 |
| 4,152,272 | 5/1979 | Young | 252/8.8 |
| 4,234,627 | 11/1980 | Schilling | 252/174.11 |
| 4,238,531 | 12/1980 | Rudy et al. | 427/242 |
| 4,339,356 | 7/1982 | Whyle | 252/174.11 |
| 4,394,127 | 7/1983 | Melville | 252/174.11 |
| 4,421,792 | 12/1983 | Rudy et al. | 427/242 |
| 4,536,315 | 8/1985 | Ramachandran et al. | 252/174.11 |

FOREIGN PATENT DOCUMENTS 0294206 12/1988 European Pat. Off. .

OTHER PUBLICATIONS

Technical Bulletin of Davison Chemical Company, "Multifunctional Silicas for the Food Industry—SYLOID".

*Primary Examiner*—Paul Lieberman
*Assistant Examiner*—John F. McNally
*Attorney, Agent, or Firm*—Robert B. Aylor; Richard C. Witte

[57] ABSTRACT

Perfume particles which are especially useful when incorporated into a fabric softening composition are formed by adsorbing a perfume composition onto silica particles. Those particles having a diameter of greater than about one micron also can be used to reduce the shiny appearance of visible softener spots which occasionally are present on fabrics treated with said fabric softening compositions and to maintain a relatively constant viscosity of the molten softening composition.

24 Claims, No Drawings

PERFUME, PARTICLES, ESPECIALLY FOR USE IN DRYER RELEASED FABRIC SOFTENING/ANTISTATIC AGENTS

CROSS-REFERENCE TO RELATED APPLICATION

This application is a continuation-in-part of commonly assigned, copending application of the same title, U.S. Ser. No. 07/164,678, filed Mar. 7, 1988, now abandoned.

FIELD OF THE INVENTION

The invention pertains to perfume particles especially adapted for inclusion in dryer activated solid fabric softener compositions including coated particles of fabric softener which are added to a detergent composition for use in the washing of fabrics. The compositions release softener to the fabrics in a heated laundry (fabric) dryer. The invention improves the aesthetic character of any fabric softener deposits on fabrics. The perfume particles can also be admixed with detergent granules and can either be coated or uncoated.

BACKGROUND OF THE INVENTION

The advantages obtained from the application of fabric conditioning agents (i.e., fabric softeners and/or antistatic agents) to laundered fabrics are well known. The present invention particularly pertains to dryer activated softener compositions including coated particulate softener/antistatic compositions which survive the wash process and release the active softening/antistatic agent and perfumes to the laundered fabrics in the dryer.

Perfumes are a desirable part of the laundry process. They are used to cover up the chemical odors of the cleaning ingredients and provide an aesthetic benefit to the wash process and, preferably, the cleaned fabrics. However, perfumes are, in general, volatile and many perfume ingredients can be destroyed or damaged by contact with cleaning ingredients, especially alkali and bleaches.

One solution to this incompatibility problem is encapsulation of the perfume. This increases the expense and does not always provide sufficient protection. It has been suggested to put encapsulated perfumes into fabric softener particles designed to survive the wash to provide additional protection and maximize delivery of the perfume to the fabrics.

Detergent compositions containing softening compounds are known in the art. U.S. Pat. No. 3,936,537, Baskerville Jr., issued Feb. 3, 1976, and U.S. Pat. No. 4,095,946, Jones, issued June 20, 1978, teach the use of intimate mixtures of organic dispersion inhibitors (e.g., stearyl alcohol and fatty sorbitan esters) with solid fabric softener to improve the survival of the softener in the presence of detergent in the washer so the softener can act on the fabrics when it melts in the dryer. U.S. Pat. No. 4,234,627, Schilling, issued Nov. 18, 1980, teaches microencapsulation of fabric softener. The microcapsules survive the wash and adhere to the fabric surface. They are then ruptured by subsequent tumbling of the fabric in the dryer, thereby releasing softener to the fabrics.

It is known in the food industry to put flavors onto silica gel particles to form dry, flowable flavor powders. Flavor oil to silica gel ratios of up to 3:1 can be used. When the particles are added to water, the flavor is released.

SUMMARY OF THE INVENTION

The present invention is directed to perfume particles in which the perfume is adsorbed onto certain silica particles, especially silica gels. The silica particles are then preferably incorporated, at least in part, into dryer-activated fabric softening compositions, preferably, detergent-compatible particles. The particles comprise a fabric softener composition comprising at least about 10% of a fabric softener, preferably at least about 10% of a cationic fabric softener compound. For detergent compatibility the particles should have a coating as described hereinafter, a sufficiently large particle size (e.g., a minimum dimension greater than about 5,000 microns, or some combination of coating and particle size depending upon the identity of the softener, the other materials in the fabric softening composition, etc. Other suitable dryer activated fabric softener compositions are those which are coated on a substrate and added directly to the dryer. The silica particles have a diameter of from about 0.001 micron to about 15 microns and are present at a level to provide from about 0.001% to about 5% perfume in detergent compositions, or from about 0.02% to about 10% perfume in softener compositions. In addition to protecting the perfume, the silica particles, when they have a diameter of greater than about one micron and are present at a level of at least about 4% in said dryer-activated fabric softening compositions, preferably said particles, also make occasional ordinarily-shiny fabric softener deposits less shiny and, therefore, less noticeable and, by keeping the viscosity of the softener composition relatively constant across the temperature range of a laundry dryer, provide more even release of said fabric softener.

Perfume delivery via solid fabric softeners in laundry fabric dryers is desirable in two ways. Product malodors are covered by the addition of perfume to the softener composition, and perfume can be transferred onto fabric with the softener actives in the laundry fabric dryer. Present technologies add perfume directly into the softener actives independent of the other softener components, or add the perfume in encapsulated form into the softener matrix. Addition of perfume oil into the softener matrix allows the perfume to freely migrate creating an unstable condition. Encapsulation of the perfume adds additional expense and complexity. Creating dry flowable silica perfume particles before addition to the softener matrix creates a cost effective, stable product that delivers perfume onto laundry fabric in an efficient manner.

The silica perfume particles can be incorporated into laundry detergents either, as is, or encapsulated in, e.g., fabric softener. It is believed that when the silica perfume particles are encapsulated in fabric softener particles, they are attached to the fabric and provide sustained release of perfume, especially when the fabric is wet, as when soaked with perspiration.

DETAILED DESCRIPTION OF THE INVENTION

The present invention relates to silica perfume particles which can be added, e.g., to solid laundry detergent compositions or solid softener compositions.

The Perfume Particles

Silica particles are used as carriers for perfumes to make dry flowable perfume compositions. In general, it is desired that the total amount of perfume to achieve the desired impact level on dry fabric be adsorbed on (includes absorbed in) the silica. The perfume oil adsorption is affected by particle size (microns) and surface area ($m^2/g$). In general, the amount of perfume that can be adsorbed per unit weight of silica is greater for small particle sizes. However, it is usually preferred not to load the perfume particles to the maximum loading. Perfume to silica particle ratios can range from about 0.001:1 to about 6:1, depending upon the silica particle, with the preferred ratios being from about 0.1:1 to about 3:1, more preferably from about 0.2:1 to about 2.5:1.

The perfume can be sprayed onto the silica in various ways well known in the trade.

The perfume compositions of this invention are the conventional compositions known in the art which are not also considered to be flavors. Selection of any perfume or amount of perfume is based solely on aesthetic considerations. Suitable perfume compositions can be found in the art including U.S. Pat. Nos. 4,145,184, Brain and Cummins, issued Mar. 20, 1979; 4,209,417, Whyte, issued June 24, 1980; 4,515,705, Moeddel, issued May 7, 1985; and 4,152,272, Young, issued May 1, 1979, all of said patents being incorporated herein by reference. Desirably, the perfume compositions are relatively substantive to maximize the effect on the fabrics, especially when the perfume particles are incorporated in the preferred softener particles, described hereinafter. However, it is a special advantage of perfume delivery via the perfumed silica particles in softeners in the dryer that nonsubstantive perfumes are effective.

A substantive fragrance is one that contains a sufficient percentage of substantive fragrance materials so that when the fragrance is used at normal levels in laundry products, it deposits a desired odor on the laundered fabrics. In general, the degree of substantivity of a fragrance is roughly proportional to the percentages of substantive fragrance materials used. Relatively substantive fragrances contain at least about 1%, preferably at least about 10%, substantive fragrance materials.

Substantive fragrance materials are those odorous compounds that deposit on fabrics via the laundry process and are detectable by people with normal olfactory acuity. Such materials typically have vapor pressures lower than that of the average fragrance material. Also, they typically have molecular weights of 200 or above, and are detectable at levels below those of the average fragrance material.

The perfumes are adsorbed onto silica particles, preferably fumed silica particles for detergent compositions and preferably silica gel particles for softener compositions when the additional benefits described hereinafter are desired. The silica particles have a particle size of from about 0.001 micron to about 15 microns, preferably from about 0.007 micron to about 5 microns, most preferably from about 0.007 to about 2.5 microns, and even more preferably from about 0.007 micron to about 0.25 micron, when the particles are added directly to a detergent composition and from about 1 micron to about 8 microns, preferably from about 2 microns to about 6 microns when the particles are added to softener particles. The surface area is from about 100 to about 800 $m^2/g$, preferably from about 200 to about 400 $m^2/g$. It is desirable to use a larger amount of silica particles than the minimum amount necessary to adsorb the perfume composition. Use of lower ratios of perfume to silica provides improved protection of the perfume. In detergent products, the silica particles are used at a level of from about 0.001% to about 2%, preferably from about 0.1% to about 1%, to provide a level of perfume of from about 0.001% to about 1.5%, preferably from about 0.01% to about 0.2%. These very small particle size silicas should be added in a way to minimize dusting, e.g., with an agglomerating aid and/or dust suppressor. The dust suppressor should not be aqueous since water will release the perfume prematurely.

Silica gel particles include Syloid® silicas such as Numbers: 72; 74; 221; 234; 235; 244; etc. Syloid® silicas are available from W. R. Grace & Co., Davison Chemical Division, P.O. Box 2117, Baltimore, Md. 21203. Such particles have surface areas of from about 250 to about 340 $m^2/g$; pore volumes of from about 1.1 to about 1.7 cc/g; and average particle sizes of from about 2.5 to about 6 microns. Fumed silica particles have primary particle diameters of from about 0.007 to about 0.025 micron and include Cab-0-Sil® Numbers: L-90; LM-130; LM-5; M-5; PTG; MS-55; HS-5; and EH-5. Cab-0-Sil® silicas are available from Cabot Corp., P.O. Box 188, Tuscola, Ill., 61953. It is preferred that there be only minimal amounts of other materials present when the perfume is added to the silica particles to maximize adsorption. It is especially preferred that only small amounts, e.g., less than about 10% of organic materials, including waxes, be present.

In a preferred embodiment the silica particles with the perfume adsorbed are incorporated in the softener particles as described hereinafter as part of the "masking adjuvant" also described hereinafter.

It is often desirable that silica gel particles be used in softener compositions to maintain the desired viscosity range, e.g., from about 5,000 to about 30,000 mPas, preferably from about 8,000 to about 20,000 mPas, of the softener when it is in the molten form, while improving the aesthetic character of any subsequent noticeable softener deposits on fabric. The desired level of silica gel particles in solid softener compositions is from about 2% to about 15%, preferably from about 4% to about 12%. The particle size that is desired for softener compositions is from about 1 micron to about 15 microns, preferably from about 2 microns to about 6 microns. The overall perfume levels that are desired in softener compositions are from about 0.01% to about 10%. Preferably the perfume level is from about 0.2% to about 8%, and more preferably from about 1% to about 6% in softener compositions.

In a preferred aspect of this invention, the perfume silica particles can be used to release perfume when they are wetted, e.g., with an aqueous fluid. When the particles are attached to substrates such as fabrics, skin, absorbent materials, etc., they can be activated upon wetting. When the aqueous material is undesirable such as sweat, urine, menses, etc., the perfume can be either a masking aid or an aesthetically pleasing "signal" that other action is required. As pointed out hereinafter, solid softener compositions applied in laundry fabric dryers are a desirable way to attach the perfume silica particles to fabrics. Solid "stick" deodorant compositions can be used to apply the perfume silica particles to skin and adhesives can be used to attach the perfume silica particles to absorbent materials and/or articles comprising absorbent materials. Suitable anhydrous antiperspirant and deodorant compositions which can be used are disclosed in U.S. Pat. Nos. 4,725,432, May, issued Feb. 16, 1988; 4,126,679, Davy et al., issued Nov. 21, 1978; and 4,280,994, Turmey et al., issued June 28, 1981; European patent application No. 28,853, Beckmeyer et al., published May 20, 1981; and copending U.S. pat. application Ser. No. 055,488, Farris et al., filed May 28, 1987, for antiperspirant compositions, all of said patents and applications being incorporated herein by reference.

Suitable absorbent articles which can utilize the perfume silica particles to hide/detect unwanted liquids include U.S. Pat. Nos. 4,685,915, Hasse and Steinhardt, issued Aug. 11, 1987; 4,578,071, Buell, issued Mar. 25, 1986; 4,397,645, Buell, issued Aug. 9, 1983; 4,685,909, Berg and Stewart, issued Aug. 11, 1987; 4,657,537, Zimmerer, issued Apr. 14, 1987; 4,687,478, Vantilburg, issued Aug. 18, 1987; 4,589,876, Vantilburg, issued May 20, 1986; and 4,321,924, Ahr, issued Mar. 30, 1982, all of said patents being incorporated herein by reference.

A. Softener Compositions

The preferred small coated softener particles of the present invention comprise an inner core of a fabric softener composition which comprises a cationic fabric softener, and an outer coating which protects the inner core, preferably one which completely surrounds the core and comprises a substantially water-insoluble material having a melting point above about 35° C., preferably above about 50° C. By "substantially water-insoluble" herein is meant having a solubility in 35° C. water of less than about 50 ppm. The particles have diameters of from about 5 microns to about 1,500 microns, preferably greater than about 300 microns, and most preferably greater than about 500 microns, with a number average of from about 600 to about 900 microns. The particles typically will be of a generally spherical shape, but can also have an irregular shape. The particle sizes quoted herein refer to the largest dimension (diameter or length) of the particle.

The larger, uncoated particles having no dimension less than about 5000 microns, preferably 10,000 microns, are compatible with detergent compositions even if uncoated. Such particles are desirable for many reasons including ease of manufacture. Particles having dimensions that are less require more or less coating depending on the size. Particles having maximum dimensions of more than 1500 microns require less coating for survival. Large, "jumbo" particles are really practical only when placed in a pouch product as described hereinafter since segregation and/or loss of the particle during the laundry process are likely.

The other preferred fabric softener compositions are those which are attached to substrates for use in laundry fabric dryers. Examples of such compositions and products can be found in U.S. Pat. No.: 4,103,047, Zaki et al., issued July 25, 1978; U.S. Pat. No. 3,736,668, Dillarstone, issued June 5, 1973; U.S. Pat. No. 3,701,202, Compa et al., issued Oct. 31, 1972; U.S. Pat. No. 3,634,947, Furgal, issued Jan. 18, 1972; U.S. Pat. No. 3,633,538, Hoeflin, issued Jan. 11, 1972; and U.S. Pat. No. 3,435,537, Rumsey, issued Apr. 1, 1969, all of these patents being incorporated herein by reference. Additional examples of such compositions are described in U.S. Pat. Nos. 3,686,025, Morton; 4,073,996, Bedenk and Sagel; 3,989,631, Marsan; and 4,022,938, Zaki and Murphy; all of said patents being incorporated herein by reference.

Typical cationic fabric softeners useful herein are quaternary ammonium salts of the formula $$[R_1R_2R_3R_4N]^+Y^-$$

wherein one or two of $R_1$, $R_2$, $R_3$ and $R_4$ groups is an organic radical containing a group selected from a $C_{12}$–$C_{22}$ aliphatic radical or an alkylphenyl or alkylbenzyl radical having from 10 to 16 carbon atoms in the alkyl chain, the remaining groups being selected from $C_1$–$C_4$ alkyl, $C_2$–$C_4$ hydroxyalkyl and cyclic structures in which the nitrogen atom in the above formula forms part of the ring, and Y constitutes an anionic radical such as halide, nitrate, bisulfate, methylsulfate, ethylsulfate and phosphate, to balance the cationic charge.

In the context of the above definition, the hydrophobic moiety (i.e., the $C_{12}$–$C_{22}$ aliphatic, $C_{10}$–$C_{16}$ alkyl phenol or alkylbenzyl radical) in the organic radical $R_1$ or $R_2$ can be directly attached to the quaternary nitrogen atom or can be indirectly attached thereto through an amide, ester, alkoxy, ether, or like grouping.

The quaternary ammonium compounds useful herein include both water-soluble compounds and substantially water-insoluble compounds which are dispersible in water. For example, imidazolinium compounds of the structure

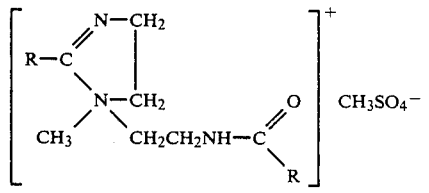

wherein R is a $C_{16}$ to $C_{22}$ alkyl group, possess appreciable water solubility, but can be utilized in the present invention.

The quaternary ammonium softener compounds used in this invention can be prepared in various ways well-known in the art and many such materials are commercially available. The quaternaries are often made from alkyl halide mixtures corresponding to the mixed alkyl chain lengths in fatty acids. For example, the ditallowalkyl quaternaries are made from alkyl halides having mixed $C_{14}$–$C_{18}$ chain lengths. Such mixed di-long chain quaternaries are useful herein and are preferred from a cost standpoint.

The anionic group which can be the counter-ion in the quaternary compounds useful herein is typically a halide (e.g., chloride or bromide), nitrate, bisulfate, ethylsulfate, or methylsulfate. The methylsulfate and chloride ions are the preferred counter-ions from an availability standpoint; while the methylsulfate anion is most preferred because of its minimization of corrosive effects on the automatic clothes dryers in which it is used.

The following are representative examples of quaternary ammonium softening compounds suitable for use in the present invention. All the quaternary ammonium compounds listed can be included in the present invention, but the compilation of suitable quaternary compounds hereinafter is only by way of example and is not intended to be limiting of such compounds. Dioctadecyldimethylammonium methylsulfate is an especially preferred fabric softening compound for use herein, by virtue of its high antistatic, as well as fabric softening activity; ditallowalkyldimethylammonium methylsulfate is equally preferred because of its ready availability and its good antistatic activity; other useful di-long chain quaternary compounds are dicetyldimethylammonium chloride, didocosyldimethylammonium chloride, didodecyldimethylammonium chloride, ditallowalkyldimethylammonium bromide, dioleoyldimethylammonium methylsulfate, ditallowalkyldiethylammonium chloride, ditallowalkyldipropylammonium bromide, ditallowalkyldibutylammonium fluoride, cetyldecylmethylethylammonium chloride, bis-[ditallowalkyldimethylammonium] bisulfate, tris-[ditallowalkyldimethylammonium] phosphate, 1-methyl-1-tallowamidoethyl-2-tallowimidazolinium methylsulfate, and the like. Particularly preferred quaternary ammonium fabric softening compounds are ditallowalkyldimethylammonium chloride and ditallowalkyldimethylammonium methylsulfate. The fabric softener core of the preferred coated particles of the invention comprises from about 70% to about 98% and most preferably about 85% to about 97% of the particle. All percentages herein are "by weight" unless otherwise indicated.

The softener compositions, e.g., the core composition of the preferred coated particles, can consist entirely of cationic fabric softeners and the "masking adjuvant" described in detail hereinafter. The softener composition, e.g., core, will generally comprise at least 10%, usually from about 10% to about 90%, preferably from about 20% to about 60%, cationic fabric softener. Optionally, and preferably, the composition can contain additional materials besides the perfume particles described hereinbefore, including auxiliary fabric softening agents (e.g., smectite clay, fatty alcohols and fatty amine(s), such as ditallowmethyl amine or 1-tallowamidoethyl-2-tallowimidazoline), soil release agents, fabric brighteners, etc. Additional disclosure of materials which can be applied to fabrics along with cationic fabric softening agents in a laundry dryer and, therefore, can be part of the core composition of the particles herein, are disclosed in U.S. Pat. No. 4,073,996, Bedenk et al., issued Feb. 14, 1978; U.S. Pat. No. 4,237,155, Kardouche, issued Dec. 2, 1980; and U.S. Pat. No. 4,421,792, Rudy et al., issued Dec. 20, 1983, all incorporated herein by reference.

The "Masking" Adjuvant

The "masking" adjuvants, or agents, are water-insoluble, particulate materials that have a particle size of from about one micron to about 15 microns, preferably with a mean of about 2.5 microns. The particles are preferably irregular in shape to promote light diffraction. Smaller particles can be present, but are relatively ineffective and larger particle sizes are undesirable from an efficiency standpoint. A relatively tight distribution of particle sizes is preferred. The particle size range is typically from about one micron to about 15 microns, preferably from about 2 to about 10 microns, more preferably from about 2.5 to about 6 microns average diameter on a weight basis. In addition to the particles that are inside the above ranges, small amounts of particles outside said ranges can also be present. Particles within the said ranges are believed to be the operable particles.

The preferred masking adjuvant particles are the silica particles carrying perfume described hereinbefore and also include the silica gels themselves, such as aerogels and xerogels and agglomerated fumed silicates. Aerogels are preferred. Suitable materials include Syloid ® 234, Syloid ® 235, Syloid ® 244, and Syloid ® 245.

The primary function of this adjuvant is twofold. The primary function is to reduce the number and/or size of visible deposits of fabric softener on fabrics. In addition, the adjuvant reduces the shiny appearance of melted softener deposits on fabric surfaces. During wash and rinse cycles of a laundry process utilizing a detergent composition comprising the coated or uncoated fabric softener particles herein, the particles are either retained in a pouch, or a substantial number of the particles either adhere to the fabric(s), or become entrapped in the fabric(s). When a load of the fabrics is subsequently dried in an automatic clothes dryer at temperatures that typically can ange from about 40 to about 120 degrees Centigrade (40°–120° C.), but which more commonly do not exceed about 85° C. The fabric softener melts or is mobilized by the action of heat and moisture, and is distributed throughout the fabric load. In a "pouch" or "sheet" execution of the type described hereinafter, the pouch retains the particles throughout the laundry process. When the pouch and the laundry (fabrics) are subsequently placed in the laundry dryer, the softener in the particles melts and/or is mobilized by the action of the heat and moisture so that said softener is transformed to the fabrics by contact between the pouch and the fabrics during the drying cycle. In a sheet execution, the sheet is added to the dryer at the start of the drying cycle.

In order to provide masking, the masking particles must be distributed (dispersed) throughout the softener and must remain dispersed. The amount of masking particles required is from about 4% to about 20%, preferably from about 6% to about 15%, more preferably from about 8% to about 12% by weight of the softener composition.

The Coating Materials

The preferred coating materials used in the preferred coated particles are substantially water-insoluble materials, typically (but not necessarily) selected from waxy materials such as paraffinic waxes, microcrystalline waxes, animal waxes, vegetable waxes, saturated fatty acids and fatty alcohols having from 12 to 40 carbon atoms in their alkyl chain, and fatty esters such as fatty acid triglycerides, fatty acid esters of sorbitan and fatty acid esters of fatty alcohols, or from substantially water-insoluble polymers. Typical specific suitable waxy coating materials include lauric, myristic, palmitic, stearic, arachidic and behenic acids, stearyl and behenyl alcohol, microcrystalline wax, beeswax, spermaceti wax, candelilla wax, sorbitan tristearate, sorbitan tetralaurate, tripalmitin, trimyristin and octacosane. A preferred waxy material is stearyl alcohol.

Examples of water-insoluble polymeric materials which can be used for the coating of the particles herein are cellulose ethers such as ethyl, propyl or butyl cellulose; cellulose esters such as cellulose acetate, propionate, butyrate or acetate-butyrate; ureaformaldehyde resins, polyvinyl chloride, polyvinylidene chloride, polyethylene, polypropylene, polyacrylates, polymethacrylates, polymethyl-methacrylates and nylon. Such materials and their equivalents are described in greater detail in any conventional handbook of synthetic organic plastics, for example, in *Modern Plastics Encyclopaedia Volume,* Vol. 62, No. 10A (for 1985–1986) at pages 768–787, published by McGraw-Hill, New York, N.Y. (October 1985), incorporated herein by reference. A preferred polymeric material is ethyl cellulose. The polymeric coating materials can be plasticized with known plasticizing agents such as phthalate, adipate and sebacate esters, polyols (e.g., ethylene glycol), tricresyl phosphate, castor oil and camphor. These polymeric coatings are preferred for the superior protection they provide.

The coating surrounds the cationic fabric softener core and is present in an amount of from about 2% to about 30%, preferably from about 3% to about 15% by weight of the particle.

The coating material can comprise a mixture of waxy coating materials and polymeric coating materials. In such mixtures the waxy coating material will typically comprise from about 70% to about 90% of the mixture and the polymeric material about 30% to about 10%.

Typically, the coating material will have a hardness which corresponds to a needle penetration value of about 0.6 mm or less, and preferably less than about 0.1 mm, as measured by ASTM Test D-1321, modified by using a 100 g weight instead of a 50 g weight. The test is performed at 25°-27° C. In the case of polymeric coating materials, sample preparation is accomplished by dissolving the polymer in a volatile solvent and then evaporating the solvent after the polymer solution has been placed in the test container. For waxy coating materials, sample preparation is done by melting the sample and then solidifying it in the test container in the manner set forth in the ASTM method.

TABLE 1

Penetration Values of Representative Coating Materials

| Material | Penetration in mm |
|---|---|
| Stearyl alcohol | 0.57 |
| Ethyl cellulose | 0.09 |
| Cellulose acetate | 0.00 |
| Ethyl cellulose + 10% dibutyl sebacate | 0.00 |
| 70% Stearyl alcohol + 30% $C_{30}$ alcohol | 0.32 |
| 90% Stearyl alcohol + 10% Elvax-4310[1] | 0.12 |
| 90% Stearyl alcohol + 10% BE-Square-195[2] | 0.40 |

[1]Terpolymer of ethylene, vinyl acetate and acid from DuPont
[2]Microcrystalline wax from Petrolite, Specialty Polymers Group The function of the coating which surrounds the fabric softener is to prevent the softener from becoming dissolved and/or dispersed in the wash water when the particles are present during the wash step of a laundry process, and thereby prevent interaction between the fabric softener and the detergent. During the washing and rinsing of the fabrics, a substantial amount of the particles adhere to, or become entrapped within folds of the fabrics. When the fabrics are dried in a heated automatic clothes dryer (typically at temperatures of about 65° to 85° C.), the coating and the fabric softener core composition melt, thereby permitting the softener to spread throughout the fabric load and soften the fabrics. The coating materials are disclosed in the copending U.S. patent application of Wierenga et al. for DETERGENT COMPATIBLE, DRYER RELEASED FABRIC SOFTENING/ANTISTATIC AGENTS, Ser. No. 058,449, filed June 5, 1987.

If the softener particles will survive the conditions of use and be available in the clothes dryer, a coating is not required.

If the particles are incorporated into a granular detergent composition, it is preferred that the particle size of the softener particles be similar to the particle size of the detergent granule in order to minimize segregation. This will typically be in the range of from about 500 to about 1,500 microns. Softener particles which are smaller in size than the detergent granules can be agglomerated to form larger particles to match the particle size of the detergent granules into which they will be incorporated. The agglomeration can be accomplished by using water-soluble or dispersible materials such as polyvinyl alcohol, sodium carboxymethyl cellulose, gelatin and polyoxyethylene waxes. The agglomerates disintegrate when the detergent composition is added to water. Methods and agglomerating agents for agglomeration of fabric softener particles are described in U.S. Pat. No. 4,141,841, McDanald, issued Feb. 27, 1979, incorporated by reference herein.

B. Preparation of Particles

In preparing the preferred coated softener particles of the invention, the solid fabric softener composition and the "masking" adjuvant (MA), which are to be the core of the particles, are formed into particles having a size of from about 5 to about 1,500 microns. This can be accomplished, for example, by milling the solid softener composition or by melting the composition, mixing the MA into the resulting melt, and spraying the melt through appropriate sized nozzles into an atmosphere having a temperature below the melting point of the softener, thereby forming the softener-composition/MA mixture into solid particles.

The particles of softener-composition/MA can then be coated with coating material which is typically either melted or dissolved in a volatile solvent. The coating can be done at a temperature which is below the melting point of the softener composition, and the coated particles are then cooled (or the solvent is evaporated) to solidify the coating. The coating is typically applied in a fluidized bed type apparatus. A suitable type of apparatus is that described in U.S. Pat. No. 3,196,827, Wurster et al., issued July 27, 1965, incorporated by reference herein. In this apparatus, solid softener core particles are suspended in an air stream which carries them in a smooth cyclic flow past the coating nozzle, which sprays them with fluid coating material. Air atomizes and expels the coating fluid through the coating nozzle. The atomized coating fluid covers the surfaces of the core particles. The coated particles are lifted on the air stream and the fluid coating solidifies on the surface of the particles as the air stream lifts them away from the nozzle. The particles then settle out of the air stream and begin another cycle which takes them past the nozzle again. The process is repeated until the desired amount of coating has been deposited on the particles. The amount of coating applied to the softener core particles is typically from about 2% to about 30%, preferably about 3% to about 15% by weight of total particle (i.e., core plus coating).

Alternatively, other types of encapsulating processes such as described in an article by Nack entitled "Microencapsulation Techniques, Applications and Problems," J. Soc. Cos. Chem., Vol. 21, Pages 85-98 (Feb. 4, 1970), incorporated herein by reference, can be used. When perfume microcapsules are incorporated, the processes disclosed in U.S. Pat. No. 4,234,627, supra, incorporated herein by reference, can be used.

If it is desired to agglomerate the softener/MA particles, this can be accomplished in the following manner. The softener particles are fed to a highly efficient mixer (e.g., Schugi Flexomix Model 160,335 or 400 from Schugi Process Engineers USA, 41-T Tamarack Circle, Skillman, N.J. 08558), or a pan agglomerator. Aqueous solution or dispersion of agglomerating agent is sprayed onto the moving particles causing them to stick to each other. The water is evaporated and the dried agglomerated particles are sized by sieving. Suitable agglomerating agents include dextrin starches, Pluronic Polyols (copolymers of ethylene oxide and/or propylene oxide with either ethylene glycol or propylene glycol) and hydratable salts such as sodium tripolyphosphate or sodium sulfate.

The type of apparatus described in U.S. Pat. No. 3,196,827 (Wurster et al.), cited supra, can also be used for agglomerating particles.

C. Detergent Compositions

The perfume particles of the present invention and/or the softener particles containing said perfume particles, can be formulated into detergent compositions. Such compositions typically comprise detersive surfactants and detergency builders and, optionally, additional ingredients such as bleaches, enzymes, fabric brighteners and the like. The particles are present in the detergent composition at a level sufficient to provide from about 0.5% to about 10%, and preferably from about 1% to about 5% of quaternary ammonium fabric softener in the detergent composition. The remainder of the detergent composition will comprise from about 1% to about 50%, preferably from about 10% to about 25% detersive surfactant, and from about 10% to about 80%, preferably from about 20% to about 50% of a detergency builder, and, if desired, other optional laundry detergent components.

1. The Surfactant

Surfactants useful in the detergent compositions herein include well-known synthetic anionic, nonionic, amphoteric and zwitterionic surfactants. Typical of these are the alkyl benzene sulfonates, alkyl- and alkylether sulfates, paraffin sulfonates, olefin sulfonates, alkoxylated (especially ethoxylated) alcohols and alkyl phenols, amine oxides, alpha-sulfonates of fatty acids and of fatty acid esters, alkyl betaines, and the like, which are well known from the detergency art. In general, such detersive surfactants contain an alkyl group in the $C_9$–$C_{18}$ range. The anionic detersive surfactants can be used in the form of their sodium, potassium or triethanolammonium salts; the nonionics generally contain from about 5 to about 17 ethylene oxide groups. $C_{11}$–$C_{16}$ alkyl benzene sulfonates, $C_{12}$–$C_{18}$ paraffin-sulfonates and alkyl sulfates are especially preferred in the compositions of the present type.

A detailed listing of suitable surfactants for the detergent compositions herein can be found in U.S. Pat. No. 3,936,537, Baskerville, issued Feb. 3, 1976, incorporated by reference herein. Commercial sources of such surfactants can be found in McCutcheon's EMULSIFIERS AND DETERGENTS, North American Edition, 1984, McCutcheon Division, MC Publishing Company, also incorporated herein be reference.

2. Detergency Builders

Useful detergency builders for the detergent compositions herein include any of the conventional inorganic and organic water-soluble builder salts, as well as various water-insoluble and so-called "seeded" builders.

Nonlimiting examples of suitable water-soluble, inorganic alkaline detergent builder salts include the alkali metal carbonates, borates, phosphates, polyphosphates, tripolyphosphates, bicarbonates, silicates, and sulfates. Specific examples of such salts include the sodium and potassium tetraborates, bicarbonates, carbonates, tripolyphosphates, pyrophosphates, and hexametaphosphates.

Examples of suitable organic alkaline detergency builder salts are: (1) water-soluble amino polyacetates, e.g., sodium and potassium ethylenediaminetetraacetates, nitrilotriacetates, and N-(2-hydroxyethyl)nitrilodiacetates; (2) water-soluble salts of phytic acid, e.g., sodium and potassium phytates; (3) watersoluble polyphosphonates, including sodium, potassium and lithium salts of ethane-1-hydroxy-1,1-diphosphonic acid, sodium, potassium, and lithium salts of methylenediphosphonic acid and the like.

Seeded builders include such materials as sodium carbonate or sodium silicate, seeded with calcium carbonate or barium sulfate. Hydrated sodium Zeolite A having a particle size of less than about 5 microns is particularly desirable.

A detailed listing of suitable detergency builders can be found in U.S. Pat. No. 3,936,537, supra, incorporated herein by reference.

3. Optional Detergent Ingredients

Optional detergent composition components include enzymes (e.g., proteases and amylases), halogen bleaches (e.g., sodium and potassium dichloroisocyanurates), peroxyacid bleaches (e.g., diperoxydodecane-1,12-dioic acid), inorganic percompound bleaches (e.g., sodium perborate), activators for perborate (e.g., tetraacetylethylenediamine and sodium nonanoyloxybenzene sulfonate), soil release agents (e.g., methylcellulose) soil suspending agents (e.g., sodium carboxymethylcellulose) and fabric brighteners.

D. Pouched Compositions

When fabric softener particles of the invention are added to the wash step of a laundering process, it is inevitable that some of the particles will not adhere to or become trapped in the folds of the fabrics and will, therefore, be lost in the discarded wash solution or rinse water. In order to avoid such loss, the particles can be added to the wash solution in a sealed, porous water-insoluble pouch such as the type described in U.S. Pat. No. 4,223,029, Mahler et al., issued Sept. 16, 1980, incorporated by reference herein. Detergent granules can be included in the pouch with the softener particles. When the pouch is placed in water in the wash step of the laundering process, the detergent dissolves, but the softener particles remain in the pouch. The pouch remains with the fabrics through the wash and rinse. When the pouch is tumbled with the fabrics in the dryer, the softener particles release the softener, which melts onto the pouch material and is transferred from the pouch material to the fabrics as the pouch comes into contact with the fabrics during the drying cycle. Preferred pouch structures are multi-pouch porous sheet structures such as described in application U.S. Ser. No. 675,804, Bedenk/Harden, issued Jan. 27, 1987; and U.S. Pat. No. 4,259,383, Eggensperger et al., issued Mar. 31, 1981, both incorporated herein by reference. In a single pouch structure, the particles tend to collect in a relatively small area of the structure, whereas in a multi-pouch sheet structure the softener particles are distributed over a larger area of the structure thereby facilitating more even transfer of softener to fabrics in the dryer.

Suitable pouch materials include, paper, nonwoven synthetics such as spunbonded and wet laid polyester, and porous formed film plastic sheet material.

All percentages, parts, and ratios herein are by weight unless otherwise specified.

EXAMPLE I

The formulation hereinafter described is a perfumed silica gel made on a lab scale according to the following method.

A predetermined amount of silica gel is placed into a Cuisinart® food processor and a fluid bed state is achieved by the action of the processor's blades. Knowing the desired amount of perfume impact on dry fabric and, hence, the desired perfume to silica gel ratio, the premeasured perfume is added through a small orifice into the fluid bed of silica gel until all the perfume has been applied. Mixing is continued until the perfume and silica gel have reached a homogenous dry flowable state.

| Ingredient | Wt. % |
|---|---|
| Syloid ® 234* | 51.61 |
| Perfume | 48.39 |
| Total | 100.00 |

*Available from W. R. Grace & Co., Davison Chemical Division, P.O. Box 2117, Baltimore, Maryland 21203. Average particle size 2.5 microns on a weight basis and surface area of 250 $m^2/g$.

Two different perfumes are as follows:

| Substantive Perfume (A) | | Relatively Nonsubstantive Perfume (B) | |
|---|---|---|---|
| Component | Wt. % | Component | Wt. % |
| Benzyl Acetate | 5.0 | Alpha Pinene | 5.0 |
| Benzyl Salicylate | 10.0 | Cedarwood Terpenes | 20.0 |
| Coumarin | 5.0 | Dihydro Myrcenol | 10.0 |
| Ethyl Maltol | 5.0 | Eugenol | 5.0 |
| Ethylene Brassylate | 10.0 | Lavandin | 15.0 |
| Galaxolide ® (50%) | 15.0 | Lemon Oil CP | 10.0 |
| Hexyl Cinnamic Aldehyde | 20.0 | Orange Terpenes | 15.0 |
| | | Phenyl Ethyl Alcohol | 20.0 |
| Ionone Gamma Methyl | 10.0 | Total | 100.0 |
| Lilial ® | 15.0 | | |
| Patchouli | 5.0 | | |
| Total | 100.0 | | |

The relatively nonsubstantive perfume is surprisingly effective when incorporated in the softener particles described hereinafter.

EXAMPLE II

Two perfumed fabric softener compositions are prepared by mixing 15.0 parts of each of the perfume/silica gels in Example I with 85.0 parts of the following fabric softener composition:

| Ingredient | Wt. % |
|---|---|
| Tallow Alkyl Dimethyl Amine | 38.92 |
| Stearic Acid | 37.41 |
| Methyl-1-hydrogenated tallow amido ethyl-2-hydrogenated tallow imidazolinium methyl sulfate (Varisoft ® 445)* | 23.67 |
| Total | 100.00 |

*Available from Sherex Chemical Co., P.O. Box 646, Dublin, Ohio 43017.

The fabric softener is melted prior to mixing in the perfume articles and then either cooled and ground into particles having article sizes between about 500 and about 1500 microns, or applied while in a molten state to a nonwoven substrate.

EXAMPLE III

A perfumed detergent composition is prepared by mixing 0.6 arts of the perfume/silica gel in Example I with 99.4 parts of the following granular detergent composition:

| Ingredient | Parts |
|---|---|
| Na $C_{13}$ linear alkyl benzene sulfonate | 9.5 |
| Na $C_{14}$–$C_{15}$ fatty alcohol sulfate | 9.5 |
| Ethoxylated $C_{12}$–$C_{13}$ fatty alcohol | 1.9 |
| $Na_2SO_4$ | 11.1 |
| Sodium silicate (1.6 r) | 6.5 |
| Polyethylene glycol (M.W. 8,000) | 0.7 |
| Polyacrylic acid (M.W. 1,200) | 0.9 |
| Sodium tripolyphosphate | 31.0 |
| Sodium pyrophosphate | 7.5 |
| $Na_2CO_3$ | 10.2 |
| Optical brightener | 0.2 |
| Protease enzyme (Alcalase) | 0.7 |
| Moisture | 9.3 |
| Miscellaneous | 1.0 |
| Total | 100.0 |

EXAMPLE IV

Two perfumed softener core particles are prepared by first mixing Syloid ® 234 with the perfumes of Example I to form the perfume particle compositions according to a process similar to that of Example I and then blending them into molten softener according to the following process:

| Perfumed Syloid ® | |
|---|---|
| Ingredient | Wt. % |
| Syloid ® 234 | 70.6 |
| Perfume | 29.4 |
| Total | 100.0 |

The Syloid and the perfume are blended by first adding 30 lbs. of the Syloid ® 234 to a Littleford Model FM 130 D Mixer (Littleford Bros., Inc., 15 Empire Drive, Florence, Ky., 41042). With the plow turned on, the perfume is slowly introduced dropwise through a ⅜" pipe at a rate of approximately 2–2.5 lbs/min. After 12.5 lbs. of perfume are added, the chopper is turned on for 15 seconds to evenly disperse the perfume before emptying the mixer.

Softener Core Particle

| Ingredient | Wt. % |
|---|---|
| Ditallowdimethylammonium methylsulfate (DTDMAMS) | 41.6 |
| Cetyl Alcohol | 20.7 |
| Sorbitan Monostearate | 20.7 |
| Perfumed Syloid ® 234 | 17.0 |
| Total | 100.0 |

The DTDMAMS, cetyl alcohol and sorbitan monostearate are blended together in a PVM 40 Ross mixer (Charles Ross & Sons Company, Hauppauge, N.Y., 11788) at about 71° C. The molten "triblend" is then mixed for one hour. At the end of one hour, the temperature is raised to 79°–85° C. under vacuum (about 330–430 mm Hg). When the temperature has stabilized in this range, the Ross anchor and disperser are turned on and the perfumed Syloid ® 234 is added, the mixture is blended for 5 minutes and then sheared with the Ross colloid mixer for 10 minutes. The softener composition is then poured into trays and cooled overnight at about 4° C. Particles are formed by cooling and then milling in a Fitzmill, Model DA506 (The Fitzpatrick Company, Elmhurst, Ill., 60126) at 4740 rpm's through a 4 mesh screen. The particles are then sized through 11 on 26 (U.S. Standard screens, (0.6–1.7 mm) particle size).

The particles are then coated with a 10% solution of Ethocel in methanol. The coating is applied in an 18 inch Wurster Coater (Coating Place, Inc., P.O. Box 248, Verona, Wis., 53593). The ethyl cellulose used is Ethocel Std. 10 (Dow Chemical Co., Midland, Mich., 48640), which has an Ubbelohde viscosity of 9.0–11.0, measured at 25° C. as a 5% solution in 80% toluene/20% ethanol.

The following conditions are used to apply the cellulosebased coating:

| | |
|---|---|
| Fluidizing Air | 15.8 Cu.M/min. at 40.5° C. |
| Atomizing Air Volume | 0.37 Cu.M/min. |
| Atomizing Air Rate | 5624 g/sq.cm. |
| Inlet Air Temperature | 38° C.–43° C. |
| Outlet Air Temperature | 30° C.–32° C. |
| Pump Rate | 0.2 Kg/min. |
| Nozzle Size | CPI-18-A74* |
| Partition Gap | 216 mm × 267 mm |
| Partition Size | 19 mm |
| Run Time | 55 min. |

*Available from Coating Place, Inc.

The amount of coating applied to the particles is about 3% by weight of the total coated particle weight. When the coating is completed, the softener particles are resized through 11 on 26 mesh U.S. Standard screens and are then ready for use "as is" or for blending into detergent granules.

The resulting coated particles are Composition A and Composition B, respectively.

EXAMPLE V

A detergent/softener composition is prepared by mixing 5.2 parts of the coated softener particles (Compositions A and B) of Example IV with 94.8 parts of the following granular detergent composition:

| Ingredient | Parts |
|---|---|
| Na $C_{13}$ linear alkyl benzene sulfonate | 9.5 |
| Na $C_{14}$–$C_{15}$ fatty alcohol sulfate | 9.5 |
| Ethoxylated $C_{12}$–$C_{13}$ fatty alcohol | 1.9 |
| $Na_2SO_4$ | 11.1 |
| Sodium silicate (1.6 r) | 6.5 |
| Polyethylene glycol (M.W. 8,000) | 0.7 |
| Polyacrylic acid (M.W. 1,200) | 0.9 |
| Sodium tripolyphosphate | 31.0 |
| Sodium pyrophosphate | 7.5 |
| $Na_2CO_3$ | 10.2 |
| Optical brightener | 0.2 |
| Protease enzyme (Alcalase) | 0.7 |
| Moisture | 9.3 |
| Miscellaneous | 1.0 |
| Total | 100.0 |

EXAMPLE VI

An alternate granular detergent/softener composition is prepared by mixing 5.2 parts of the coated softeners (Compositions A and B) of Example IV with 94.8 parts of the following granular detergent composition:

| Ingredient | Parts |
|---|---|
| Na $C_{13}$ linear alkyl benzene sulfonate | 11.5 |
| Na $C_{14}$–$C_{15}$ fatty alcohol sulfate | 11.5 |
| Ethoxylated $C_{12}$–$C_{13}$ fatty alcohol | 1.9 |
| $Na_2SO_4$ | 14.0 |
| Sodium silicate (1.6 r) | 2.3 |
| Polyethylene glycol (M.W. 8,000) | 1.8 |
| Polyacrylic acid (M.W. 1,200) | 3.5 |
| Hydrated Zeolite A (~2 microns) | 28.9 |
| $Na_2CO_3$ | 17.0 |
| Optical brightener | 0.2 |
| Protease enzyme (Alcalase) | 0.6 |
| Moisture and Miscellaneous | 7.0 |
| Total | 100.2 |

EXAMPLE VII

This example utilizes the softener formula of Example IV to produce large (>5,000 microns) softener particles on a lab scale using a 12-cavity porcelain plate (Fisher Scientific, 711 Forbes Ave., Pittsburgh, Pa., 15219, Catalog #13-745). A porcelain plate is placed on an electronic balance and the molten softener is added to each cavity by weight via a disposable transfer pipet (Fisher Scientific, Catalog #13-711-5A). Sample weights will be dependent on the softener's density (formulation), but, in general, 10,000 micron particles weigh about 0.25 gms, 12,000 micron particles weigh about 0.5 gms, and 15,000 micron particles weigh about 0.75 gms.

Laundering articles containing about 58 grams of either the detergent/softener composition of Example VI or about 97.3 parts of the detergent composition of Example III and 2.7 parts of the large (>5,000 microns) softener particles described above are prepared in the form of multi-pouched sheets as follows:

The pouches are comprised of two sheets of James River 9214-02 (James River Corp., Greenville, S.C.), a carded, thermobonded nonwoven composed of a bicomponent fiber consisting of a polyester core and a polypropylene sheath. The structures have an outer edge dimension of approximately 4.25 inches×7.00 inches (10.8 cm×18.6 cm). The structure is sealed on all four edges and across the middle to form two approximately equal sized pouches with outer dimensions of about 4.25 inches×3.5 inches (10.7 cm×9.4 cm). The center seals are perforated to give the user flexibility to use one pouch for small loads of laundry and two pouches for normal loads of laundry.

Each pouch is filled with about 28.3 grams of one of the detergent/softener compositions described above. The finished pouches are suitable for washing and softening laundry in a process involving washing and rinsing the fabrics, followed by tumble drying in a heated clothes dryer, wherein the pouch remains with the laundry throughout the entire process.

EXAMPLE VIII

An alternate detergent/bleach/softener formula is prepared by mixing 2.7 parts of the softener particles of Example IV or 1.4 parts of the softener particles of Example VII with 97.3 or 98.6 parts of the following granular detergent composition:

| Ingredient | Parts |
|---|---|
| Na $C_{13}$ linear alkyl benzene sulfonate | 11.7 |
| Na $C_{14}$–$C_{15}$ linear fatty alcohol sulfate | 5.0 |
| Sodium nonoyloxybenzene sulfonate | 6.6 |
| Sodium perborate monohydrate | 5.0 |
| Sodium sulfate | 6.8 |
| Sodium silicate | 4.3 |
| Polyethylene glycol (M.W. 6,000) | 0.5 |
| Polyacrylic acid (M.W. 1,500) | 1.0 |
| Sodium tripolyphosphate | 30.0 |
| Sodium carbonate | 21.4 |
| Optical brightener | 0.5 |
| Protease enzyme | 0.6 |
| Moisture and Miscellaneous | 6.6 |
| Total | 100.0 |

The above detergent, softener and bleach is prepared in the form of a multi-pouched sheet as follows:

The pouches are comprised of two sheets of James River 9214-02 (James River Corp., Greenville, S.C.), a carded, thermobonded nonwoven composed of a bi-component fiber consisting of a polyester core and a polypropylene sheath. The structures have an outer edge dimension of approximately 5.70 inches×7.33 inches (14.5 cm×18.6 cm). The structure is sealed on all four edges and across the middle to form two approximately equal sized pouches with outer dimensions of about 5.70 inches×3.7 inches (14.5 cm×9.4 cm). The center seals are perforated to give the user flexibility to use one pouch for small loads of laundry and two pouches for normal loads of laundry.

Each pouch is filled with about 54.8 grams of the above detergent/softener composition. described above. The finished pouches are suitable for washing and softening laundry in a process involving washing and rinsing the fabrics, followed by tumble drying in a heated clothes dryer, wherein the pouch remains with the laundry throughout the entire process.

EXAMPLE IX

A dryer-added fabric softening article comprising a rayon nonwoven fabric substrate having a weight of 1.22 gms per 99 sq. in. (approximately 639 $cm^2$) and a fabric softening composition is prepared in the following manner.

Perfume particles are prepared by spraying the liquid perfume onto an equal weight of Syloid 244 (Davison Chemical) in a rotating cylindrical tumbler.

A fabric softening agent premixture is initially prepared by admixing at 70° C. 135.3 parts octadecyldimethylamine with 121.6 parts $C_{16}$–$C_{18}$ fatty acid mixture (Emersol 132 from Emery Industries, containing about 50% $C_{16}$, about 46% $C_{18}$, and about 3% $C_{14}$ fatty acids) and 94.3 parts $C_{12}$–$C_{14}$ fatty acid mixture (C-1214 from Procter & Gamble Industrial Chemicals, containing about 73% $C_{12}$, about 23% $C_{14}$, and about 2% $C_{16}$). The softening agent mixture is completed by then adding and mixing in 219.8 parts of sorbitan monostearate and 219.8 parts of ditallowdimethylammonium methylsulfate at 70° C. After the addition is completed and a sufficient period of mixing time has elapsed, 88.0 parts of Bentolite L particulate clay is added slowly while maintaining the high-shear mixing action. An amount of 121.2 parts of perfume particles is added with stirring to complete the preparation of the fabric softening composition.

| Ingredient | Wt. % |
|---|---|
| Octadecyldimethylamine | 13.53 |
| $C_{16}$–$C_{18}$ fatty acids[a] | 12.16 |
| $C_{12}$–$C_{14}$ fatty acids[b] | 9.43 |
| DTDMAMS[c] | 21.98 |
| Sorbitan monostearate | 21.98 |
| Clay[d] | 8.80 |
| Perfume | 6.06 |
| Amorphous Silica[e] | 6.06 |
| Total | 100.00 |

(a) Emersol 132 from Emery Industries, containing about 50% $C_{16}$, about 46% $C_{18}$, and about 3% $C_{14}$ fatty acids.

(b) C-1214 from Procter & Gamble Industrial Chemicals, containing about 73% $C_{12}$, about 23% $C_{14}$, and about 2% $C_{16}$.

(c) Ditallowdimethylammonuium methylsulfate.

(d) Bentolite L particulate clay from Southern Clay Products.

(e) Syloid 244 (Davison Chemical).

The flexible substrate, comprised of 70% 3-denier, 1-9/16 inches (approximately 4 cm) long rayon fibers and 30% polyvinyl acetate binder, is impregnated by coating one side of a continuous length of the substrate with said fabric softening composition and contacting it with a rotating cylindrical member which serves to press the liquified mixture into the interstices of the substrate. The amount of fabric softening composition applied is controlled by the flow rate of the mixture and/or the line speed of the substrate. In this Example, the application rate provides 2.05 gms of fabric softening composition per individual sheet. The substrate is passed over several chilled tension rolls which help solidify the fabric softening composition. The substrate sheet is 9 inches (approximately 23 cm) wide and is perforated in lines at 11 inch (approximately 28 cm) intervals to provide detachable sheets. Each sheet is cut with a set of knives to provide three evenly spaced parallel slits averaging about 4 inches (approximately 10 cm) in length.

What is claimed is:

1. A dry, flowable silica particle having a particle size of from about 0.001 micron to about 15 microns and having a perfume composition suitable for use in a fabric conditioning process adsorbed onto said silica particle, the ratio of said perfume composition to the silica particle being from about 0.001:1 to about 6:1 and there being no more than about 10% based on the weight of the silica and the perfume of other organic materials present.

2. The particle of claim 1 wherein said silica particle is a silica gel having a particle size of from about 1 micron to about 8 microns.

3. The particle of claim 2 wherein said silica particle is a silica aerogel having a particle size of from about 2 microns to about 6 microns.

4. The particle of claim 3 wherein said perfume composition is relatively substantive to said fabrics.

5. A detergent composition comprising from about 0.001% to about 2% of the particle of claim 1 wherein said silica particle is a fumed silica having a primary particle size of from about 0.007 to about 0.25 micron.

6. The composition of claim 5 wherein said silica particle is present at a level of from about 0.1% to about 1% to provide a perfume level of from about 0.001% to about 1.5%.

7. The particle of claim 6 wherein said perfume composition is relatively substantive to said fabrics.

8. The particle of claim 7 wherein said silica particle is present at a level of from about 0.1% to about 1% to provide a perfume level of from about 0.001% to about 1.5%.

9. The particle of claim 8 wherein said perfume composition is present at a level of from about 0.01% to about 0.2%.

10. A solid dryer-activated fabric softener composition comprising:

(i) at least about 10% of fabric softener, the said softener composition having a melting point of from about 50° C. to about 80° C. and (ii) at least 4% of a perfumed silica gel particle of claim 1, the ratio of perfume to silica gel being from about 0.1 to 3.

11. The dryer-activated fabric softener composition of claim 10 in the form of detergent compatible particles.

12. The particulate composition of claim 11 comprising a coating surrounding said softener particles which are the inner core to protect said softener from detergents; the said coating comprising from about 2% to about 30% of said coated softener particles and solid inner core softener particles comprising from about 98% to about 70% of said coated softener particles, wherein the said coated softener particles have a size of from about 5 to about 1500 microns and the coating has a melting point above about 35° C. and a penetration value of no more than about 0.6 mm as measured by ASTM Test D-1321, modified by using a 100 gram weight.

13. The particulate composition of claim 12 wherein the coating (b) comprises a material selected from substantially water-insoluble polymers, paraffinic waxes, microcrystalline waxes, animal waxes, vegetable waxes, saturated fatty acids, saturated fatty alcohols and saturated fatty esters.

14. The particulate composition of claim 11 wherein said silica particle is a silica gel having a particle size of from about 2 microns to about 6 microns.

15. The particulate composition of claim 14 wherein said silica particle is a silica aerogel, and the level of the perfume is from about 0.02% to about 10% in the softener.

16. The composition of claim 10 wherein said perfume is relatively substantive.

17. The composition of claim 10 wherein said perfume is relatively nonsubstantive.

18. The composition of claim 10 wherein said fabric softener composition is attached to a substrate suitable for addition to an automatic laundry fabric dryer.

19. A particulate detergent composition comprising the particles of claim 11 at a level to provide from about 0.5% to about 10% fabric softener.

20. The detergent composition of claim 19 contained in a sealed, water-insoluble pouch.

21. The process of providing perfume release from the particles of claim 1 by wetting them with water.

22. The process of claim 21 wherein said silica particles are attached to a substrate.

23. The process of claim 22 wherein said substrate is selected from the group consisting of absorbent materials, nonabsorbent portions of articles comprising absorbent materials, and mixtures thereof.

24. The process of claim 21 wherein the particles are deposited on skin.

* * * * *

UNITED STATES PATENT AND TRADEMARK OFFICE

CERTIFICATE OF CORRECTION

PATENT NO. : 4,954,285

DATED : September 4, 1990

INVENTOR(S) : Thomas J. Wierenga; Joseph M. Ladd, Jr.; Russell J. Merz; and Alyce E. Nicholson It is certified that error appears in the above-identified patent and that said Letters Patent is hereby corrected as shown below:

TITLE PAGE:

[54] Title: "PERFUME, PARTICLES, ESPECIALLY FOR USE IN DRYER RELEASED FABRIC SOFTENING/ANTISTATIC AGENTS" should read -- PERFUME PARTICLES, ESPECIALLY FOR USE IN DRYER RELEASED FABRIC SOFTENING/ANTISTATIC AGENTS --.

Col. 1, line 1, "PERFUME," should read -- PERFUME --.

Col. 12, line 60, after "675,804" insert -- Bedenk et al., filed Nov. 28, 1984, now U.S. Pat. Nos. 4,638,907 --.

Col. 13, line 20, before the table insert -- Perfume/silica gel composition is prepared as follows: --.

Signed and Sealed this

Twenty-eighth Day of July, 1992

*Attest:*

DOUGLAS B. COMER

*Attesting Officer*

*Acting Commissioner of Patents and Trademarks*